US005676492A

United States Patent [19]

Van Steijn

[11] Patent Number: 5,676,492

[45] Date of Patent: Oct. 14, 1997

[54] APPARATUS AND METHOD FOR SHEARING TUBES OF A LATTICE STRUCTURE, IN PARTICULAR SUBAQUEOUSLY

[75] Inventor: Theodorus Gerardus Wilhelmus Van Steijn, Linschoten, Netherlands

[73] Assignee: IHC Handling Systems V.O.F., Cmberkel En Rodenrijs, Netherlands

[21] Appl. No.: 516,787

[22] Filed: Aug. 18, 1995

[30] Foreign Application Priority Data

Aug. 31, 1994 [NL] Netherlands ..... 94-01407

[51] Int. Cl.[6] ..... B26D 5/08

[52] U.S. Cl. ..... 405/195.1; 83/54; 83/609

[58] Field of Search ..... 405/195.1, 227, 405/232, 191; 114/312, 313; 83/54, 607, 609; 606/1, 120, 167

[56] References Cited

U.S. PATENT DOCUMENTS

| | | | |
|---|---|---|---|
| 3,056,267 | 10/1962 | McRee | 405/191 |
| 3,667,515 | 6/1972 | Corey | 83/743 |
| 3,741,517 | 6/1973 | Pogonowski | 251/5 |
| 3,754,428 | 8/1973 | Alexoff | 83/54 X |
| 4,452,286 | 6/1984 | Menzi | 83/607 X |
| 4,519,135 | 5/1985 | LaBounty | 83/609 X |
| 4,746,246 | 5/1988 | Cowan et al. | 405/191 |
| 5,384,962 | 1/1995 | Pemberton | 83/609 X |

FOREIGN PATENT DOCUMENTS

| | | |
|---|---|---|
| 9104057 | 3/1988 | Germany . |
| 2736129 | 11/1991 | Germany . |

*Primary Examiner*—Tamara L. Graysay
*Assistant Examiner*—Tara L. Mayo
*Attorney, Agent, or Firm*—Ladas & Parry

[57] ABSTRACT

Pipe shears for cutting tubes of a subaqueous structure, in which the pipe shears are suspended from a vessel to a location at which a tube of the subaqueous structure is to be cut and removed. The pipe shears is formed by two clamping jaws, hingedly connected about a first hinge axis, and a hydraulic cylinder for moving the clamping jaws towards and away from each other. The jaws have opposed flat faces which flatten the tube when the jaws are moved together. A cutting device is located adjacent to the jaws for shearing the tube adjacent to the flattened portion thereof clamped between the clamping jaws. When the tube has been sheared by the cutting device, a separated section of tube can be lifted to the surface while the flattened portion remains clamped in the jaws.

15 Claims, 3 Drawing Sheets

APPARATUS AND METHOD FOR SHEARING TUBES OF A LATTICE STRUCTURE, IN PARTICULAR SUBAQUEOUSLY

FIELD OF THE INVENTION

The invention relates to an apparatus for shearing tubes of a structure, such as in particular a substructure of an oil or gas platform, also called jacket structure. Such structures have been installed for instance in the Gulf of Mexico and the North Sea.

BACKGROUND

When the exploitation of oil or gas fields is terminated, the platforms set up on those fields lose their function. Leaving the platform behind can cause future damage to the environment, but can also constitute a danger for shipping traffic. For that reason, it is increasingly often required that after the exploitation of an oil or gas field has been terminated, the platform is completely removed. The superstructure, which is clearly visible, can herein be removed in a known manner, whether after having been split up into separate parts or not. Removing the substructure, which has been secured on the seabed, is more difficult, however. These lattice structures are removed by divers, who subaqeously cut the tubes with cutting torches, water jet cutters or explosives or the like, after which the detached pieces of tube can be raised. This work is dangerous, expensive and time-consuming, while moreover the subaqueous employment of people is often not allowed for reasons of safety in the case of heavy seas and swell, as a consequence of which the position of the crane ship may be insufficiently controllable.

SUMMARY OF THE INVENTION

It is an object of the invention to improve upon this, which is achieved by means of an apparatus for cutting tubes of a subaqueous structure, comprising means for fastening to a suspension means, such as a stick or a cable, at least two clamping jaws, hingedly about a first hinge axis connected to each other, means for moving the clamping jaws towards each other and away from each other and shearing means for cutting a tube clamped between the clamping jaws.

The apparatus according to the invention can be lowered from an auxiliary vessel, if necessary provided with stabilizing means, to a position near the tube portion to be sheared. Herein, positioning means and/or video means (ROV), known in the art, can be used to bring the apparatus to the right location prior to cutting. Due to the hinge structure by which the clamping jaws are connected to each other, the clamping jaws are positioned obliquely relative to each other, by which, on the one hand, a large receiving opening is realized and, on the other hand, a guide means is provided for the tube after it has entered the receiving opening, so that the tube is securely positioned within the clamping jaws. These clamping jaws can thereafter be closed to flatten the tube between them. During the subsequent cutting, the clamping jaws continue to keep the tube clamped in the flattened condition, so that the apparatus substantially maintains its orientation and the cutting action can be optimum, wherein the reaction forces can be transferred to the (still secured) tube structure.

The shearing means preferably comprises a cutting tool and a knife, the cutting tool being formed by one of the clamping jaws and the knife being arranged adjacent to the other clamping jaw. In this context, a cutting tool is first of all meant to be a counter knife, that is to say a supporting edge along which the actual knife can move in order to, in this case, actually shear the tube.

The knife is preferably hingedly supported about a second hinge axis arranged on the apparatus, the second hinge axis being situated in or near the plane in which the clamping faces of the clamping jaws are also located if they are in their fully closed position.

The second hinge axis of the knife can be located between the clamping faces of the clamping jaws and the first hinge axis of the clamping jaws, which is preferred in consideration of the equilibrium of forces and structural simplicity.

The first hinge axis is preferably located on the side of the apparatus situated away from the clamping faces. Consequently, relatively small opening angles are attainable between the clamping faces.

The fastening means, considered in projection on the said plane in which the clamping faces will be situated, can also be located in a horizontal sense between both said hinge axes.

In order to promote the positioning of the apparatus on the tube to be sheared, the clamping jaws are provided on their ends with pilot edges for the tube to be sheared. This facilitates the reception of the tube in the receiving opening.

The positioning of the tube in the space between the clamping jaws is furthered promoted if, in the opened position of the clamping jaws, the knife aids to form the boundary of that receiving space. Morever, the knife is then at once positioned against the tube and upon activating the control means for the knife, it can immediately be active.

In further accordance with the invention, there is provided a method for subaqueously cutting tubes of a jacket structure, comprising the steps of lowering a pipe shears comprising a pair of cooperating clamping jaws, a knife and a cutting tool on a pipe shears suspension means; manipulating the suspension means to place the tube to be cut within a space defined by the two clamping jaws in an open position thereof; operating the clamping jaws to move them towards each other to flatten the tube between the jaws; operating the knife to cut the tube immediately next to the flattened portion thereof; and raising the pipe shears by the pipe shears suspension means.

In further accordance with the method after the step of cutting the tube and during the step of raising the pipe shears, the step of keeping the clamping jaws in the clamping position to raise a completely separated piece of tube from a remainder of the tube.

BRIEF DESCRIPTION OF THE DRAWING

Further advantageous aspects will become apparent during the following discussion of the examplary embodiment of the apparatus according to the invention shown in the accompanying drawings wherein.

DETAILED DESCRIPTION OF A PREFERRED EMBODIMENT OF THE INVENTION

Figure 1:
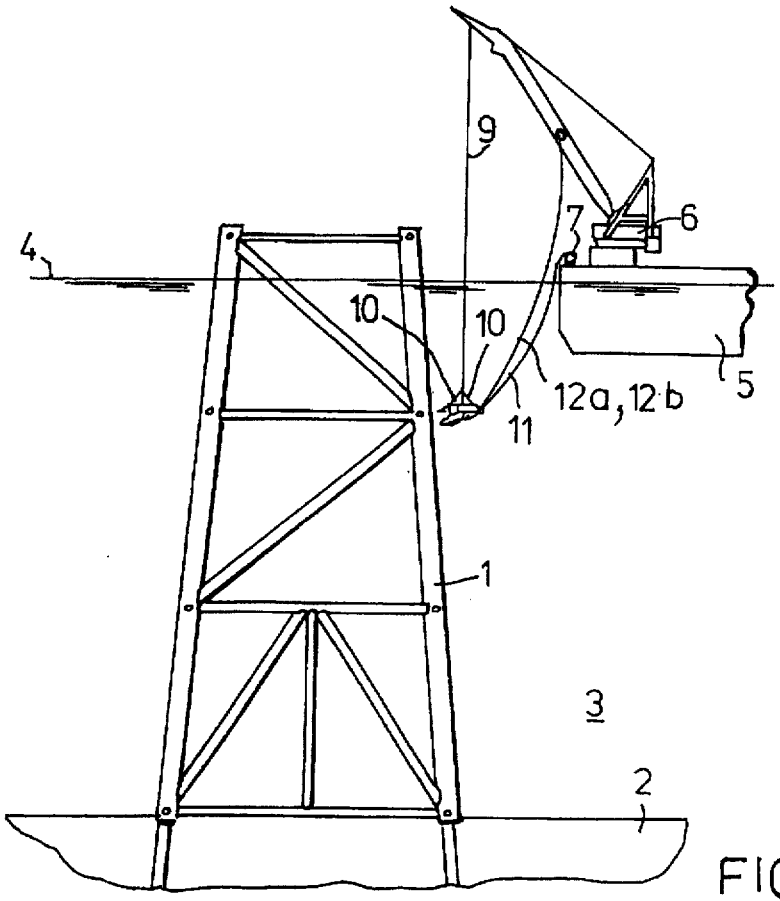
FIG. 1 is a schematic survey of the start of an operation in which a so-called jacket structure will be removed by means of an apparatus according to the invention, i.e. by shearing the tubes constituting the jacket structure.

FIG. 1 shows a jacket structure 1 which is secured on the bottom 2 of the sea 3. A working vessel or crane vessel 5 which can be provided with dynamic positioning means is floating on the water surface 4. The working vessel 5 is provided with a crane 6 from which a cable 9 runs down into the sea 3 to continue into suspension cables 10, on the lower ends of which an apparatus 8 for shearing the tubes of the jacket structure 1 is suspended, such that the cable 10 is located above the center of gravity of the apparatus 8. The rear end of the apparatus 8 is connected to winch 7 on the working vessel 5 by means of stabilizing or positioning cable 11. Furthermore, hydraulic control lines **12*a* and 12*b* extend from the working vessel 5, along the jib of the crane 6, to a diversion roller situated halfway along the jib and from there downward into the apparatus 8. In response to positioning means, not shown, such as for instance an R.O.V., the crane 6 is operated to bring the apparatus 8 to the correct height and to the correct location along a jacket structure tube to be sheared, wherein the stabilizing cable 11 in cooperation with the position of the vessel 5** ensures a correct orientation in the horizontal plane.

Figure 2B:
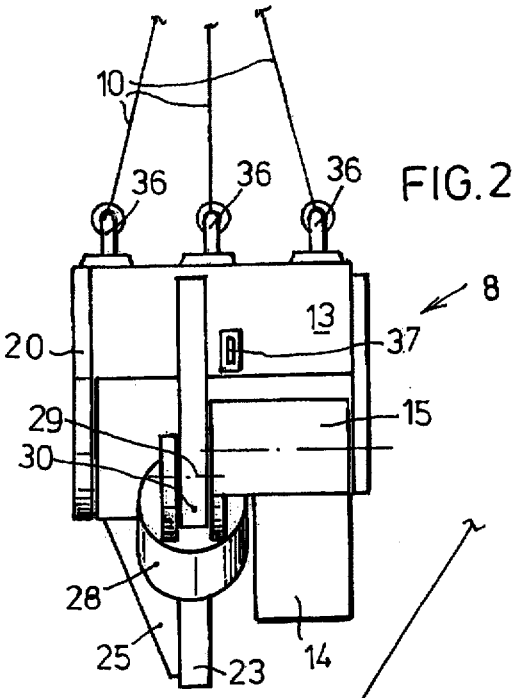
FIGS. 2A and 2B are a side view and a rear view, respectively, of an examplary embodiment of the apparatus according to the invention.
Figure 2A:
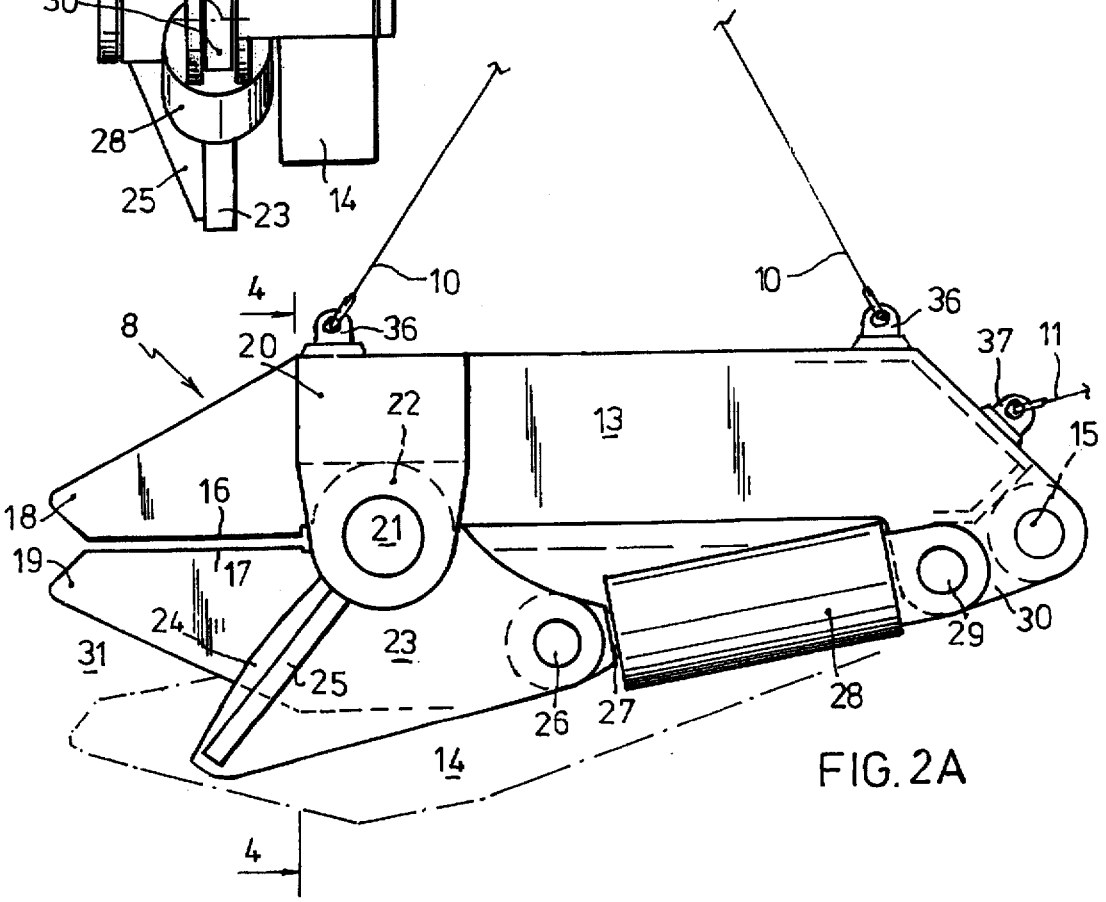

The examplary embodiment of the apparatus 8 according to the invention shown in FIGS. 2A and 2B is provided at its upper side with raised lugs 36 for connection with the lower ends of the suspension cables 10 and at its rear with a lug 37 for connection with stabilizing cable 11. The apparatus 8 moreover comprises an upper clamping jaw 13 and a lower clamping jaw 14, connected to each other at a rear end by means of hinge connection 15. At their front ends, the clamping jaws 13 and 14 are provided at their front ends with clamping faces 16 and 17, respectively, and at a location further towards the front with pilot edges 18 and 19.

As can be seen in FIG. 2B, the upper jaw 13 is wider than the lower jaw 14. On one side, a retaining plate 20 hangs from the upper jaw 13, which retaining plate 20 covers hinge 21. Hinge 21 constitutes the hinge connection between the upper jaw 13 and a sleeve 22, on the outside of which a knife 23 is provided. The knife 23 has a cutting edge 24 which, seen in FIG. 2A, is somewhat convex. In order to reinforce the knife 23 in a direction perpendicular to the plane of FIG. 2A, a rib 25 is provided. Rib 25 slopes obliquely to the outer end of the knife edge 24. On the side turned away from the knife edge 24, the knife 23 is connected via hinge connection 26 to the rod 27 of a piston cylinder assembly 28, which is connected on its other end via hinge connection 29 with the depending portion 30 of upper jaw 13 and is in fluid connection with hydraulic control line **12*a*** via means, not shown.

Figure 4:
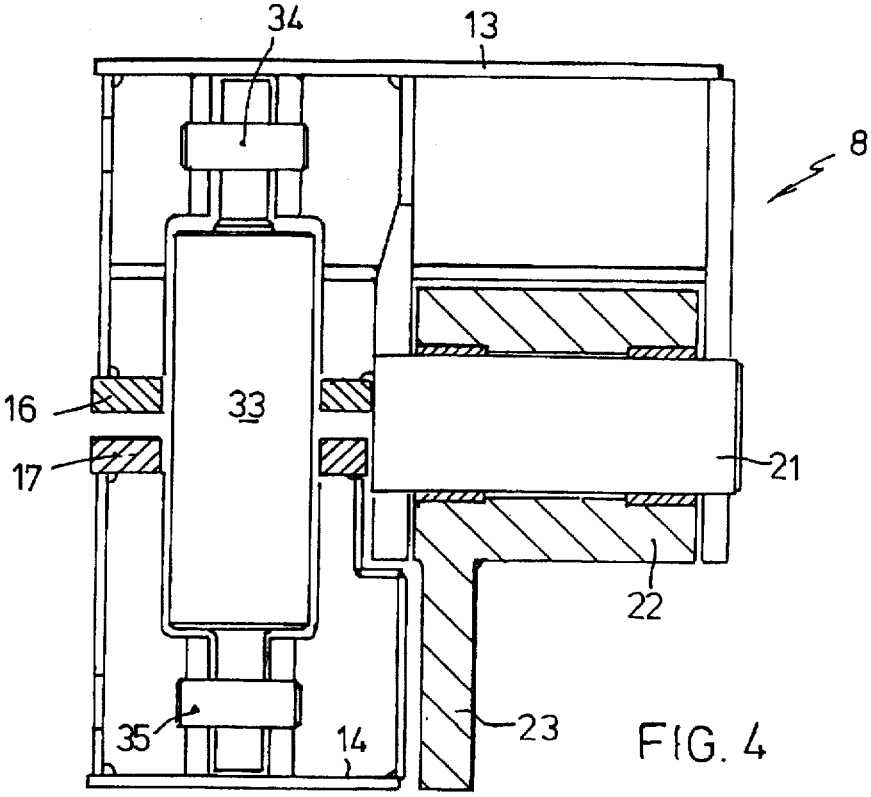
FIG. 4 is a schematic cross-section of the apparatus of FIGS. 2A and 2B, taken along line 4—4 in FIG. 2A showing the hydraulic drive for the clamping jaws.

Piston cylinder assemblies have also been provided, between the upper jaw 13 and the lower jaw 14, which piston cylinder assemblies can be operated to move the jaws 13 and 14 towards each other and away from each other. These assemblies have been schematically represented in FIG. 4. Next to the hinge 21 room has been created for hydraulic piston cylinder assembly 33, which is hingedly connected to the upper jaw 13 and the lower jaw 14 by means of pins 34 and 35, respectively. The cylinder 33 is in fluid connection with hydraulic control line **12*b*** via means, not shown.

The apparatus shown in FIGS. 2A and 2B can have a length of 9 meters and in the opened position a height of almost 4 meters and in the closed position a height of about 3 meters. The width, discernible in FIG. 2B, can therein be approximately 2½ meters. Such an apparatus is suitable for shearing tubes having an outer diameter of 1.20 meters.

When the apparatus 8 has been brought to the correct height in front of the tube to be sheared, the cable 9 is moved towards that tube and the pilot edges 18 and 19 will guide the tube into the opening 31 between the clamping faces 16 and 17. Subsequently, the clamping faces 16 and 17, which in the opened position of the clamping jaws 13 and 14 are at an angle of 15° (in case of a tube diameter of 1.20 meters) provide for further guiding of the tube in the receiving opening 31, until the tube abuts the cutting edge 24 of the knife 23.

Figure 3A:
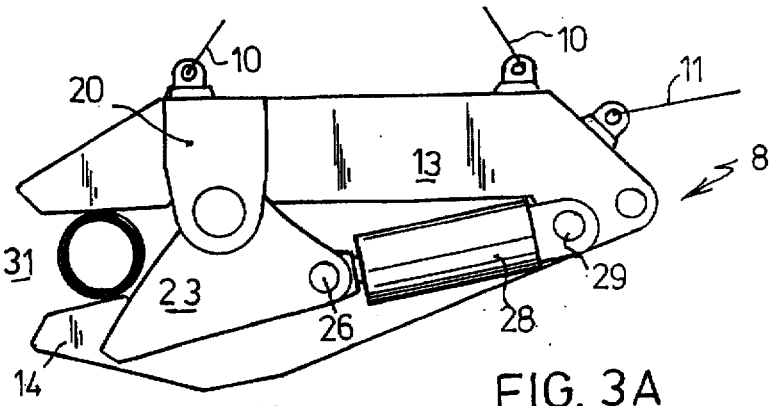
FIGS. 3A, 3B and 3C are the schematical representations of three stages in the use of the apparatus of FIGS. 2A and 2B.
Figure 3B:
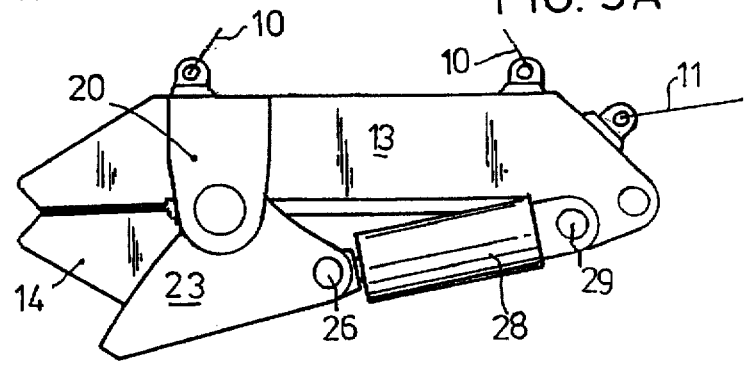
Figure 3C:
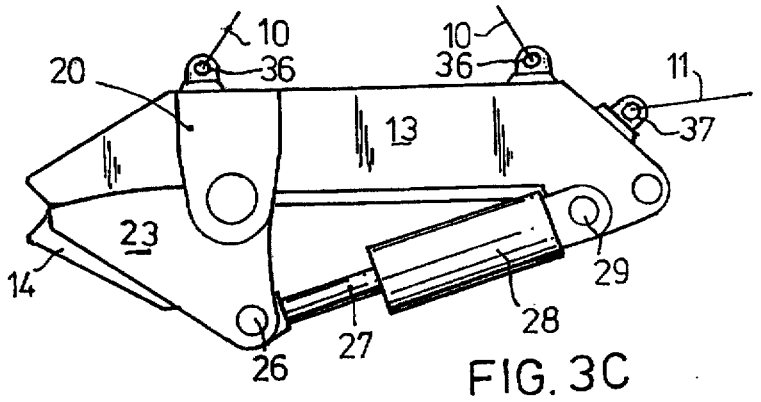
Figure 3D:
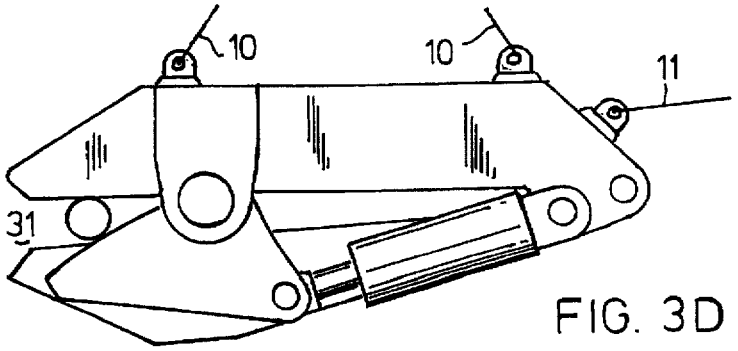
FIG. 3D is a schematical representation of the stage of use corresponding to FIG. 3A, in the case of a tube to be sheared with a small diameter.

It is remarked that the apparatus is adjusted in weight and dimensions to the diameter and the wall thickness of the tubes to be sheared. In particular the angle between the clamping faces in the opened position of the apparatus 8 will be adjusted to the outer diameter of the tube to be sheared. An illustration hereof has been shown in FIG. 3D.

When the tube abuts the cutting edge 24, the tube is positioned relative to the apparatus 8, such that the subsequent action will be positively performed. This includes activating the cylinder 33 arranged between the upper and lower jaw 13 and 14, respectively (FIG. 4), by which the jaws 13 and 14 and thereby the clamping faces 16 and 17 are pressed forcefully towards each other. The angle between the clamping faces 16 and 17 is so small in relation to the diameter of the tube, that during the movement towards each other of the clamping faces, the tube will not slide out from the opening between the clamping faces. The location of the hinge 15, relatively far away from the clamping faces, makes small angles between the clamping faces in the receiving position possible. The closing force is so great that the tube is almost completely flattened at that location. When operation of the cylinders connecting the upper jaw and the lower jaw is continued, the apparatus 8 is clamped securely on the tube and is thereby substantially kept static. Subsequently (see FIG. 3C) the cylinder 28 is operated by which the piston rod 27 is extended and the knife 23 is rotated about the hinge connection 22, whereby the cutting edge 24 is moved through the tube, immediately next to the flattened portion thereof, to cut the tube in two at that location. The result of the location of hinge connection 22 is, that the cutting moment increases over a significant part of the cutting stroke.

After shearing the tube, the cylinders can be released to move the knife and the clamping jaws back to their initial position. It can, however, also be advantageous, in particular when the tube part concerned has already been sheared elsewhere, to continue to clamp the tube which has just been sheared between the clamping faces 16 and 17 during raising of the cable 9 to thereby raise the clamped and cut-off portion of the tube.

It will be understood that the apparatus according to the invention forms a safe and reliable provision for shearing jacket structures into pieces for removal, above water level, but in particular also subaqueously. It will moreover be clear that the apparatus can simply be adapted to also shear vertical tubes.

What is claimed is:

1. Apparatus for cutting tubes of a subaqueous structure, comprising means for fastening to a suspension means a shearing means for cutting tubes of the subaqueous structure, said shearing means comprising two clamping jaws, a hinge connecting the clamping jaws for pivotal movement about a first hinge axis towards and away from one another, means for moving the clamping jaws towards each other for clamping a tube to be cut between the jaws and for moving the jaws away from each other and cutting means for shearing the tube clamped between the clamping jaws.

2. Apparatus according to claim 1, wherein the cutting means comprises a cutting tool and a knife, the cutting tool being formed by one of the clamping jaws and the knife being arranged adjacent to the other clamping jaw.

3. Apparatus according to claim 2, wherein the knife is hingedly supported about a second hinge axis located parallel to the first hinge axis and being situated in or near a plane containing clamping faces of the clamping jaws.

4. Apparatus according to claim 3, wherein the second hinge axis is located between the clamping faces and the first hinge axis.

5. Apparatus according to claim 3, wherein the means for fastening the suspension means to the shearing means is located between both hinge axes.

6. Apparatus according to claim 2, wherein the clamping jaws are arranged one above the other, said cutting tool being included as part of the upper one of said clamping jaws.

7. Apparatus according to claim 1, wherein the first hinge axis is located at a distance from clamping faces of the clamping jaws.

8. Apparatus according to claim 1, wherein the clamping jaws are provided with pilot edges for engaging the tube.

9. Apparatus according to claim 1, wherein in an opened condition of the clamping jaws, the clamping jaws and the cutting means define a receiving space for the tube to be cut.

10. Apparatus according to claim 1, comprising a hydraulic cylinder for operating said cutting means, said hydraulic cylinder being linked to one of said clamping jaws.

11. Apparatus according to claim 1, wherein said means for moving said clamping jaws causes said jaws to flatten a portion of the tube clamped between the jaws, said cutting means being located relative to said clamping jaws to shear said tube adjacent to the flattened portion thereof while said flattened portion remains clamped between said jaws.

12. Apparatus according to claim 1, wherein said clamping jaws have flat faces facing one another for flattening the tube located therebetween when the clamping jaws are moved towards one another.

13. Apparatus according to claim 12, wherein said means for moving said clamping jaws comprises a hydraulic cylinder having an axis extending across said jaws to bring said jaws together to flatten said tube therebetween.

14. Method for subaqueously cutting tubes of a jacket structure, comprising the steps of lowering, a pipe shears comprising a pair of cooperating clamping jaws, a knife and a cutting tool on a pipe shears suspension means; manipulating the suspension means to place the tube to be cut within a space defined by the two clamping jaws in an open position thereof; operating the clamping jaws to move them towards each other to flatten the tube between the clamping jaws; operating the knife to cut the tube immediately next to the flattened portion thereof; and raising the pipe shears by the pipe shears suspension means.

15. Method according to claim 14, comprising after the step of cutting the tube and during the step of raising the pipe shears, the step of keeping the clamping jaws in the clamping position to raise a completely separated piece of tube from a remainder of the tube.

* * * * *